United States Patent [19]

David et al.

[11] Patent Number: 4,526,084

[45] Date of Patent: Jul. 2, 1985

[54] SHELL LOADER

[75] Inventors: Donald M. David; Gene R. Morris, both of Grand Island, Nebr.

[73] Assignee: Hornady Manufacturing Co., Grand Island, Nebr.

[21] Appl. No.: 535,223

[22] Filed: Sep. 23, 1983

[51] Int. Cl.[3] ..... F42B 33/10

[52] U.S. Cl. ..... 86/38; 86/24; 86/25; 86/27; 86/36; 86/37

[58] Field of Search ..... 86/23, 24, 28, 27, 32, 86/33, 39, 40, 43, 44, 37, 38, 25, 36

[56] References Cited

U.S. PATENT DOCUMENTS

| | | | |
|---|---|---|---|
| 3,857,319 | 12/1974 | Welch | 86/23 |
| 3,973,465 | 8/1976 | Bachhuber et al. | 86/23 |
| 4,031,804 | 6/1977 | Boschi | 86/23 |
| 4,078,472 | 3/1978 | Simpson | 86/23 |
| 4,142,441 | 3/1979 | Schaenzer | 86/24 |
| 4,163,410 | 8/1979 | Dillon | 86/23 |
| 4,329,906 | 5/1982 | Heers | 86/23 |
| 4,343,222 | 8/1982 | Dillon | 86/27 |
| 4,393,744 | 7/1983 | Lee | 86/39 |

*Primary Examiner*—Stephen J. Lechert, Jr.
*Assistant Examiner*—Howard J. Locker
*Attorney, Agent, or Firm*—Vincent L. Carney

[57] ABSTRACT

To enable a shell to be automatically primed during operation of a loader, the primers are mounted within a chute to fall by gravity to an opening where a lever is pivoted by a cam as the shell carriage of the loader moves in a vertical direction within the frame of the loader. The motion of the lever moves one of the primers from the chute into position underneath the shell carriage for insertion into the shell casing as the carriage moves downward against the base of the loader frame. The lever arm is spring-biased into position underneath the rim of the holder and contacts a cam mounted to move up and down with the carriage upon the actuating of the loader handle by an operator. The shell is deprived during the upward movement of the carriage and the downward movement.

19 Claims, 17 Drawing Figures

SHELL LOADER

BACKGROUND OF THE INVENTION

This invention relates to shell loaders.

In one class of shell loaders, a shell holder is adapted to receive shells or casings and is mounted to a carriage which is movable in a vertical direction. A handle is connected to a toggle drive mechanism to raise and lower the carriage as the handle is pivoted between substantially vertical and horizontal positions. At the top of the motion of the carriage and at the bottom, the shells contact a tool station which operates on the shells to refinish and load them.

In a prior art type of loader of this class, the reprimming cap is manually positioned in a fixed location to be received by the shell in its downward movement toward the base. The prior art method has the disadvantage of being slow and requiring an operator to correctly position the cap for the repriming operation.

In another prior art loader of this class, a shell holder is driven by a ram or piston which includes a slot having a primer arm mounted to it by a lost motion mechanism. The lost motion mechanism moves the primer arm to a position for receiving a primer in a chute when the ram moves the shell upwardly to deprime it and moves the primer arm against the bottom of the shell to insert the primer when the ram is moved downwardly. The lost motion mechanism includes a pivot pin mounted within the slot and the slot extends from the shell holder to a longitudinally offset location on the ram. The primer arm is releasably engaged with the pivot pin within the slot and oriented by the curvature of the slot to align the primer cap holder with the center of the bottom of the shell.

This type of prior art primer works well on a one-shell reloader but has certain disadvantages such as: (1) it is mounted to a piston or ram rather than to a carriage with an automatic indexing mechanism for progressive operation on a plurality of shells; (2) it is relatively complicated and expensive; and (3) it requires a complicated mechanism to mount it to the ram for small units such as shell loaders.

SUMMARY OF THE INVENTION

Accordingly, it is an object of the invention to provide a novel shell loader.

It is a still further object of the invention to provide a novel apparatus for repriming shells.

It is a still further object of the invention to provide a novel apparatus for progressively reloading shells with a hand-operated mechanism.

It is a still further object of the invention to provide a novel apparatus for automatically feeding primer caps to a shell for insertion therein in a reloading apparatus.

In accordance with the above and further objects of the invention, a loader includes a shell holder mounted to a carriage which is moved upwardly against tools and downwardly toward a base. During the upward motion, at least one shell is positioned to contact a deprimer which removes the spent primer, and during the downward motion, a primer is automatically positioned so that the shell is reprimed. Advantageously, a plurality of shells may be mounted in the holder to be progressively refinished and loaded.

To position the primer, a lever mechanism is pivoted by a cam as the carriage moves to receive a primer in a primer holder. The cam is mounted to the carriage to be raised against the lever mechanism on the base where it contacts a cam follower that causes the primer holder to move underneath a primer. The primer holder is gravity-fed a primer and then moved back into position for priming a shell.

In a progressive type loader, the shell holder is moved from shell to shell during its upward and downward motion by pawls and an indexing wheel. It is moved through one increment during the upward motion of the carriage and in the downward motion of the carriage through another increment. The shells are thus refinished and loaded progressively during this motion.

From the above description it can be understood that the shell loader of this invention provides several advantages such as: (1) it has a relatively short elevation; (2) it provides automatic priming; (3) it provides for automatic indexing both at the top and the bottom of the carriage movement; (4) it is relatively simple and inexpensive; and (5) it is relatively safe.

SUMMARY OF THE DRAWINGS

The above noted and other features of the invention will be better understood from the following detailed description when considered with reference to the accompanying drawings in which.

DETAILED DESCRIPTION

Figure 1:
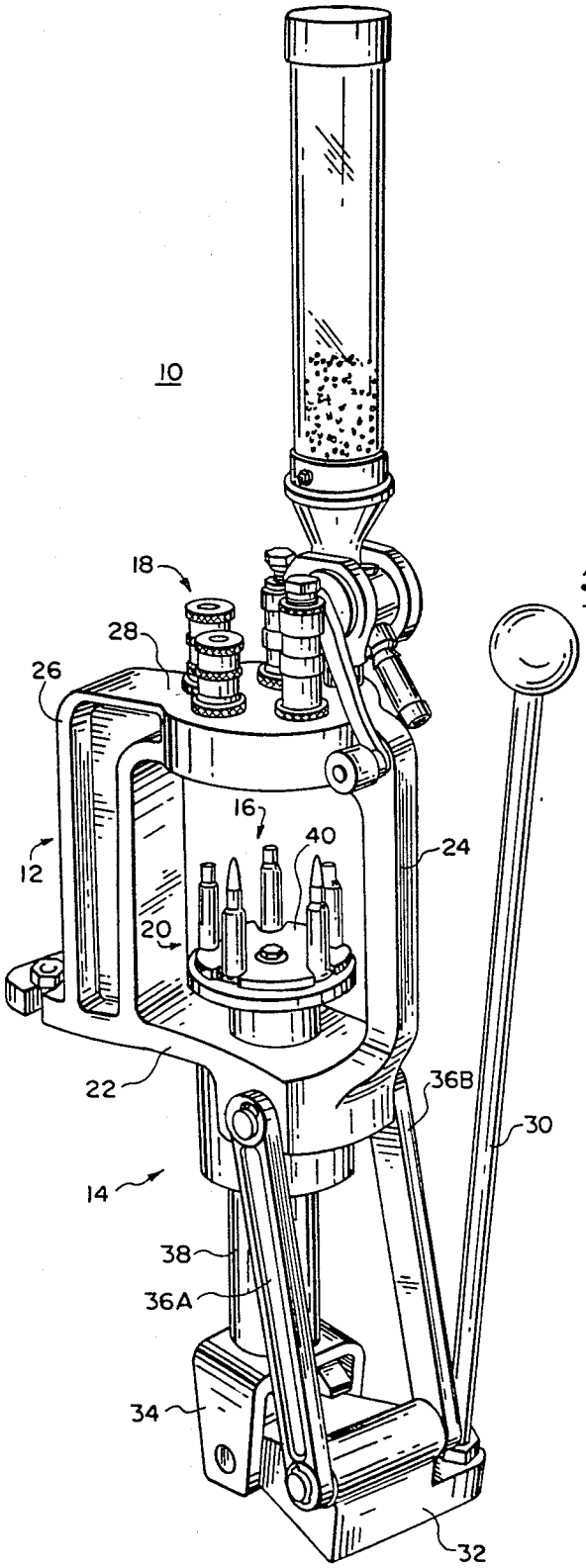
FIG. 1 is a perspective view of a loader in accordance with an embodiment of the invention.

In FIG. 1, there is shown a perspective view of a reloading apparatus 10 having a frame indicated generally at 12, a drive means 14, a turret section 16, a refinishing and loading section 18 and an automatic primer assembly 20, partly hidden in FIG. 1.

The frame 12 is adapted to be mounted to a work bench or the like and to support in cooperative arrangements: (1) the drive means 14 mounted below the frame 12; (2) the turret section 16 mounted to the drive means 14; (3) the tooling and loading section 18 at the top of the frame to cooperate with the turret section 16; and (4) the automatic primer assembly 20 mounted on the frame to cooperate with the turret section 16 and the refinishing and loading section 18. A plurality of metallic shells are mounted on the turret section 16.

To support the other parts of the reloading apparatus 10, the frame 12 is generally formed as a closed square loop having: (1) a base 22; (2) a first upstanding column 24 on one side of the base 22; (3) a second vertical upstanding column 26 on the opposite side of the base 22 parallel to the column 24; and (4) a top supporting member 28 parallel to the base 22 and adjoining the upper ends of the vertical parallel upstanding columns 24 and 26.

To guide the turret section 16, the base 22 of the frame 12 includes a cylindrical aperture passing through it to receive the top portion of the drive means 14. To support the automatic primer assembly 20, the frame 12 includes a flat upper surface with the automatic primer assembly 20 being generally below the turret section 16 to perform priming operations to be described hereinafter. The drive means 16 is pivotably mounted to a lower collar on the frame.

To mount the reloader to a bench or the like, the second vertical upstanding column 26 has a cross-section of an I beam and a bottom mounting plate adapted to be clamped or bolted to the work bench. This frame is substantially the same as the frame disclosed in U.S. Pat. No. 4,329,906, granted May 18, 1982, to Mr. Edward A. Heers and assigned to Hornady Manufacturing Company. The disclosure of the aforementioned patent is incorporated herein by reference to it as part of this disclosure.

To move the turret section 16 between the refinishing and loading section 18 and the automatic primer assembly 20, the drive means 14 includes a handle 30, a rocker arm 32, a yoke 34 and a pair of linkage arms 36A and 36B. The handle is connected to the rocker arm 32 which in turn is mounted for movement within the yoke 34 and the linkage arms 36A and 36B.

To lower the turret section 16 when the handle 30 is in a substantially vertical position as shown in FIG. 1, the linkage arms 36A and 36B connect the rocker arm 32 pivotably to the frame 12 and the rocker arm 32 is connected pivotably to the yoke 34. The yoke 34 is connected at its top to the turret section 16. To move the yoke 34 upwardly and thus drive the turret section 16 upwardly, the rocker arm 32 rotates about the linkage arms 36A and 36B when the handle 30 is pulled forward and down to a more horizontal position from that shown in FIG. 1.

The drive means 14 is substantially the same as that shown in the aforesaid patent to Heers and to that used in the Multi-Power C, Series 2, reloaders sold by Hornady Manufacturing Company, Box 1848, Grand Island, Nebr. 68801.

To progressively reload a plurality of shells, the turret section 16 includes a carriage 38, a shell holder 40 and an advancing mechanism (not shown in FIG. 1) for moving the shell holder 40. The shell holder 40 is shown supporting certain shell or cartridge casings in different stages of refinishing and reloading. The carriage 38 is connected to the yoke 34 to be raised and lowered thereby through the frame 12 and supports the shell holder 40, with the advancing mechanism being within the carriage to move the cartridge casings from station to station during the reloading process.

The refinishing and loading section 18 rests upon the top supporting plate 28 and contains the tools to refinish casings. Beneath it on the base 22, the automatic primer assembly 20 rests to automatically prime the shells after they have left a first station, which is a depriming station and before they reach the second station which expands the neck on straight wall cases.

Figure 2:
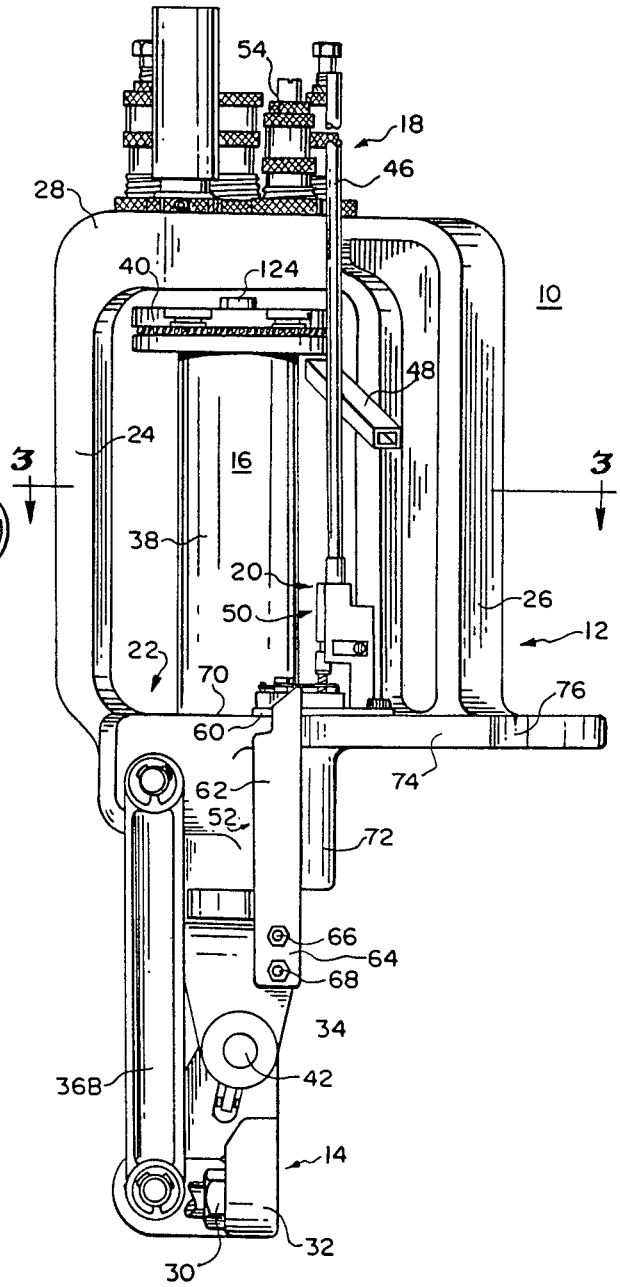
FIG. 2 is a side elevational view of the loader of FIG. 1.

In FIG. 2, there is shown a side elevational view of the reloading apparatus 10 with the handle 30 pulled downwardly to a substantially horizontal position from the substantially vertical position shown in FIG. 1. In this position, the linkage arms 36A and 36B are vertical, causing the rocker arm 32 to pivot about a pivot point 42 in the yoke 34 to lift the turret section 16 upwardly by forcing the carriage 38 and the shell holder 40 on top of the carriage 38 upward. In this position, shells are mounted in the shell holder 40 in a position to be acted upon by the tool and loading section 18.

As best shown in this view, the automatic primer assembly 20 includes a primer feed tube or chute 46, a spent primer drop tube 48, an automatic feeder 50, a primer cam assembly 52 and a sizing and depriming tool 54. When the handle 30 is pulled horizontally as shown in FIG. 2 forcing the carriage 38 and shell holder 40 upwardly, the die in the sizing and depriming tool 54 forces the spent primer out of the shell and through the primer drop tube 48 where it drops free.

When the handle 30 is pulled upwardly as shown in FIG. 1, the carriage moves downwardly so that a shell mounted in the rim of the shell holder 40 moves down to the priming position. In the priming position, the automatic primer assembly 20 causes a new primer to be inserted into the shell. For this purpose, the primer cam assembly 52 includes a cam surface 60, an arm 62 and a mounting portion 64.

To feed a primer into position, the mounting portion 64 is fastened to the yoke 34 by bolts such as those shown at 66 and 68 or by any other suitable means so that it moves upwardly when the carriage 38 is moved upwardly. The arm 62 is sufficiently long to extend between the yoke 34 to which it is fastened and a location above the base 22 when the carriage 38 is fully extended and at this time the cam surface 60 contacts the automatic feeder 50 to move an arm therein which feeds one primer under the rim of the shell holder 40 to be aligned with the center of the shell or cartridge casing.

As best shown in FIG. 2, the base 22 of the frame 12 includes a top surface 70: (1) against which the automatic feeder 50 is mounted; (2) a central portion 72 having a hole in it substantially the same size as the carriage 38 to permit the carriage 38 to move therethrough and providing sufficient bearing surfaces to steady the carriage 38 as it moves upwardly and downwardly; and (3) an extending mounting section 74 having one or more apertures 76 for mounting the frame 12 to a work bench or the like. The first and second upstanding columns 24 and 26 provide sufficient height between the top surface 70 and the refinishing and loading section 18 to permit the shell holder 40, shells and a section of the carriage 38 upward and downward movement.

To permit priming, the rim of the shell holder 40 extends beyond the carriage 38 a sufficient distance to receive the primer and the portion of the automatic feeder 50 to insert it thereunder and the automatic feeder 50 is moved by the cam surface 60 a sufficient distance to move a primer from the feed tube 46 into a path under the shell within the rim. The distance from the edge of the rim to the location of the automatic feeder 50 must be at least one half the diameter of a shell.

Figure 3:
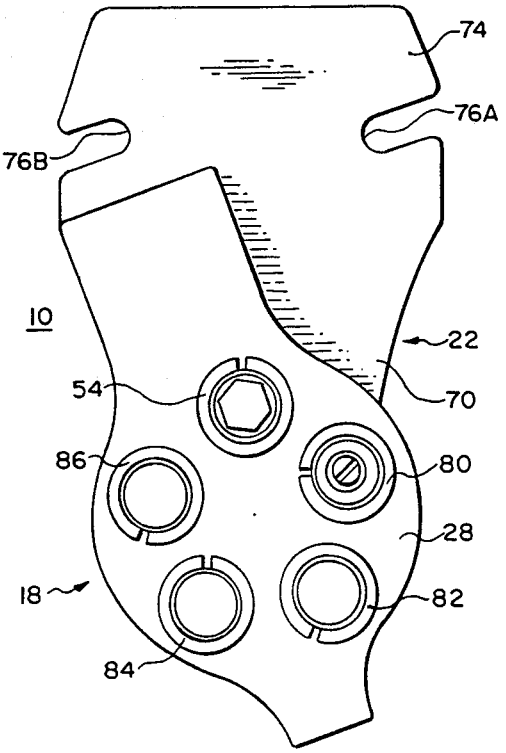
FIG. 3 is a plan view of the loader of FIG. 1.

In FIG. 3, there is shown a top view of the reloading apparatus 10, showing the refinishing and loading section 18 and the base 22 of the frame 12 (FIGS. 1 and 2). The refinishing and loading section 18 includes the top supporting member 28 to which a plurality of tools including the sizing and depriming tool 54 are mounted thereon so that, as the carriage 38 moves the shell support between the base 22 and the top member 28, the shells mounted thereon are progressively acted upon by the tools on the top member 28, with each shell being moved one station at each operation to progressively perform the next operation on the next of the shells mounted within the shell holder 40 (FIG. 2).

The different stations are mounted to the top of the top supporting member 28 to cooperate with the shells in the shell holder 40 (FIG. 2) and include the sizing and depriming tool 54, a neck expanding tool mounted at 80, a powder charge supply station mounted at 82 to supply powder after the shell has been formed, a bullet serating and/or crimping tool at 84 and a taper crimping tool in the case of pistol bullets at 86. Beneath the top supporting member 28, the base 22 extends to provide the mounting portion 74 with the openings 76A and 76B to mount the reloading apparatus 10 to an appropriate work bench.

Not all of the stations shown in FIG. 3 need be mounted but they may be selected for the particular shell or cartridge upon which work is to be done. The use of such station is conventional and known in the art and other arrangements are known and may be used instead of the arrangement shown in FIG. 3.

Figure 4:
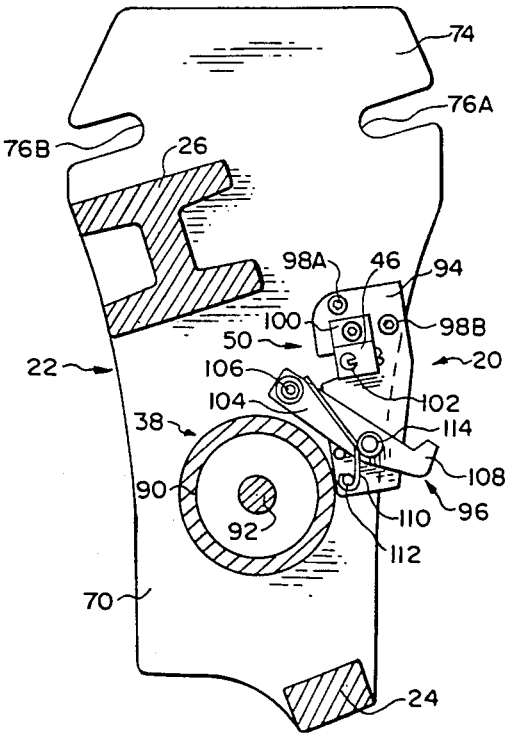
FIG. 4 is a plan sectional view of the loader of FIG. 1.

In FIG. 4, there is a top sectional view of the reloading apparatus 10 taken through the lines 3—3 on FIG. 2, showing the carriage 38, the automatic feeder 50 and the base 22. As shown in this view, the first and second support columns 24 and 26 extend upwardly from the base 22 and the carriage 38 extends therethrough adjacent to the automatic feeder 50 which feeds primers to it.

The carriage 38, in the preferred embodiment, includes a tubular wall 90 and an indexing shaft 92 centrally located within the tubular wall 90. In the preferred embodiment, the tubular wall 90 is cylindrical and has a sufficient amount of inertia to avoid buckling when the tools work on the shells at one end of the shell holder 40 (FIG. 2). The indexing shaft 92 is also cylindrical and has: (1) short enough length and a large enough moment of inertia to rotate the shell holder 40 from station to station without distortion of the indexing shaft 92; and (2) a long enough length to extend from the indexing wheel to the shell holder 40 (not shown in FIG. 4) through the tubular wall 90 as explained hereinafter.

The automatic feeder 50 includes a feeder base plate 94, the primer chute assembly 46 and a primer feed arm 96. The base plate 94 is mounted to the support surface 70 of the loader base 22 by any convenient means such as by the machine screws shown at 98A and 98B and supports the primer feed arm 96 and the primer chute assembly 46.

To supply primers to the automatic feeder 50, the primer chute assembly 46 includes a body portion 100 mounted to the base plate 94 and a hollow cylindrical primer tube 102 which includes stacked primers extending downwardly to the surface 70.

The primer feed arm 96 includes a primer moving section 104, a primer punch and seat assembly 106, a cam follower 108 and a spring 110. The spring 110 is mounted to the base plate 94 at one end to a stud 112 and at its other end to the primer moving section 104 to bias the primer punch and seat assembly 106 in a position where it underlies the shell on the shell holder 40 (FIG. 2) when that holder is moved downwardly. In the preferred embodiment, that location is one and one-half inches from the center of the tubular wall 90 which is a center of revolution of the shells on the shell holder 40 (FIG. 2).

The primer punch and seat assembly 106 is sized to receive a primer snugly and the primer moving section 104 swings under action of the cam follower 108 through an arc that brings it underneath the hollow cylindrical tube 102 where it trips a spring catch and permits a primer to be seated in the primer punch and seat assembly 106 for removal.

The primer punch and seat assembly 106 is supported by a compression spring at a height of approximately one fourth of an inch and it presses a trip under the hollow cylindrical tube 102 to release the primer and moves it laterally by the spring back to the location where shown in FIG. 4 for insertion into the shell. The hollow cylindrical tube 102 is elevated from the bottom of the support 70 by slightly less than a quarter of an inch to permit removal of the primer.

The primer feed arm 96 includes a pivot point 114 with the cam follower 108 on one side and the primer moving section 104 on the other side. The cam follower 108 is shaped so that when it is moved by the cam surface 60 (FIG. 2), the primer punch and seat assembly 106 is swung on the primer moving section 104 through the distance between the location where shown at FIG. 4 and the hollow cylindrical tube 102 to receive a primer. In the preferred embodiment, this is an arc of approximately 30 degrees. The distance from the center of the primer punch and seat assembly 106 and the center of the privot point 114 is one and one-fourth inches and the distance to the cam follower 108 is approximately one half of an inch.

Figure 5:
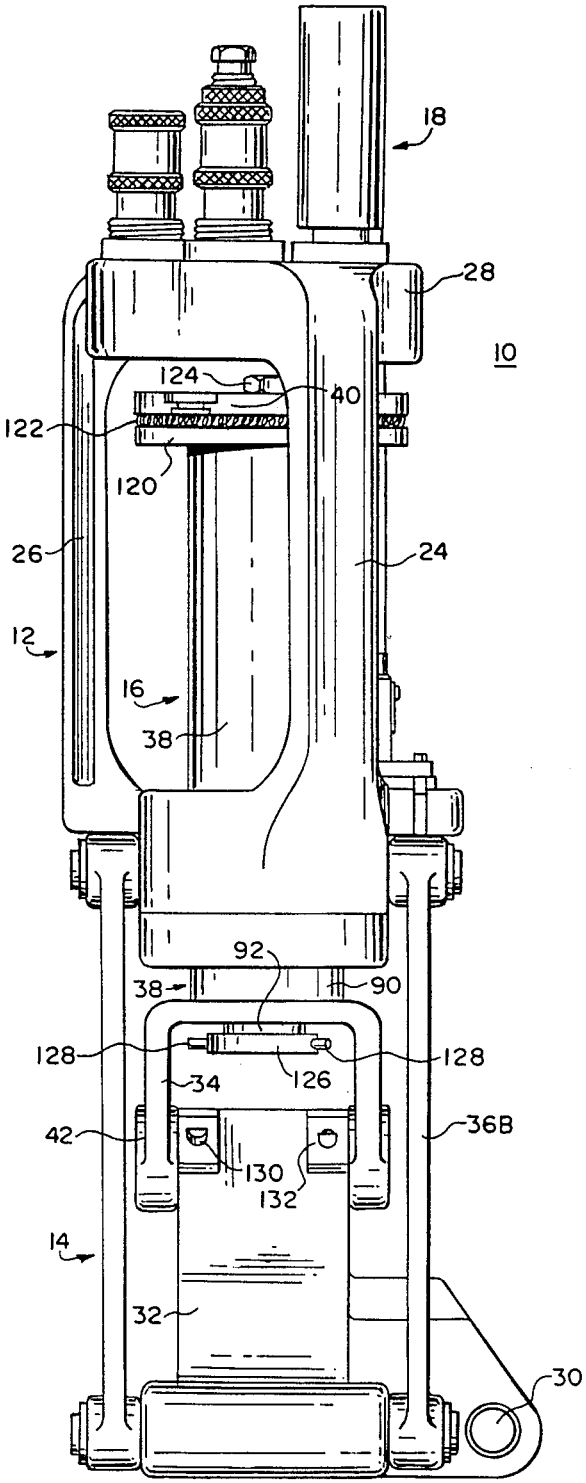
FIG. 5 is a front elevational view of the loader of FIG. 1.

In FIG. 5, there is shown a front elevational view of the reloading apparatus 10 with the handle 30 pulled horizontally to pivot the rocker arm 32 upwardly, thus lifting the yoke 34, carriage 38 and the shell holder 40 toward the refinishing and loading section 18. As best shown in this view, the turret section 16 includes an advance mechanism which cooperates with the shell holder 40 and the drive means 14 to turn the shell holder 40 from position to position for progressive working of the shells. It is part of the carriage 38 and is similar to the advance mechanism described in U.S. Pat. No. 4,031,804, issued to Richard C. Boschi on June 28, 1977 and assigned to Pacific Gunsight Company.

To permit the shell holder 40 to rotate with respect to the carriage 38, the carriage 38 includes an outer cylindrical rim 120 having openings underlying the openings in the shell holder 40 adjacent to the depriming tool and supporting a compression spring 122 about its periphery. A bolt 124 tightens the shell holder 40 against the drive shaft 92 to permit it to rotate but holds it firmly in place except as to rotating motion.

To provide rotation, the drive shaft 92 includes at its upper end a key and keyway for rotating the shell holder 40 (not shown in FIG. 5) and at its bottom end an indexing wheel 126. The indexing wheel 126 has a rounded periphery with five indexing pins extending radially from the drive shaft 92 and spaced from each other by seventy-two degrees. The pins are positioned to cooperate with first and second pawls 130 and 132 mounted to the rocker arm 32 and extending a sufficient distance outwardly to contact the indexing pins as the rocker arm is pivoted.

The pawl 130 contacts a pin and moves it thirty-six degrees clockwise as the carriage 38 is lifted upwardly and the pawl 132 contacts an indexing pin 128 and rotates the wheel 126 thirty-six further degrees in the same clockwise direction as the carriage 38 is moved downwardly to move one full station. The movement is clockwise when viewed from the top of the reloading apparatus 10. The last one-eighth of an inch downward motion of the carriage seats the primer in the shell.

Figure 6:
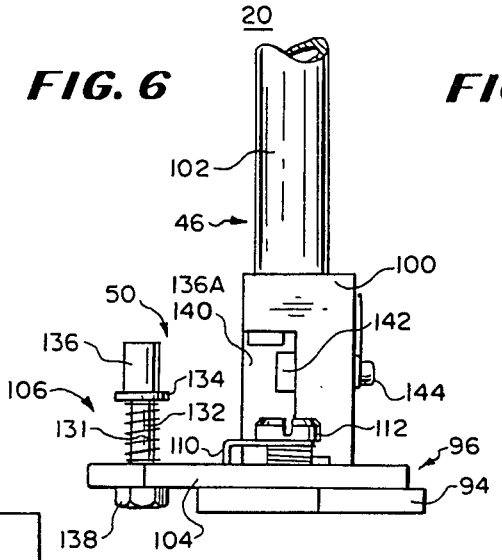
FIG. 6 is a fragmentary front-elevational view of a portion of the loader of FIG. 1.

In FIG. 6, there is shown a fragmentary front elevational view of the automatic primer assembly 20, including the primer chute assembly 46 and the automatic feeder 50. As shown in this view, the base plate 94 supports the primer feed arm 96 spaced a short distance above the surface 70 (FIG. 2) of the base 22 (FIGS. 1 and 2) and spring-biased away from the chute by the spring 110. The spring 110 is fastened to the machine screw 112, the arm 96 and the base plate 94.

As shown in this view, the primer punch and seat assembly 106 includes a punch 131, a primer cup spring 132 and a primer cup 134 adapted to receive a primer 136. The punch 131 is held in place by the jam nut 138 on the opposite side of the primer moving section 124 to hold the punch 131 extending thereabove. The primer cup spring 132 is a helical spring surrounding the punch 131 and positioned between the top surface of the primer moving section 104 and the primer seat 134 to provide a cushioning effect thereto.

The body portion 100 of the primer chute assembly 46 has a cutaway portion 140 on one side, a body spring member 142 and a spring screw 144. The spring screw 144 is threaded through a tapped hole and through the body spring 142 which extends horizontally across the body 100 and into the cut-away portion 140 to control the dropping of primers from the chute 102 into the seat 134. It includes an inwardly extending edge 142A that is hit by the cup 134 to release a primer such as the primer 136A held at its upper horizontal portion.

Although in the preferred embodiment a hollow carriage is disclosed which may be automatically rotated to advance shells, other embodiments are possible and have been proposed. One such embodiment which has the disadvantage of moving more slowly includes a revolvably mounted shell registering plate similar to the shell plate 40 except that it is adapted to be manually rotated to advance the shell positions.

In this embodiment, the tools which are supported at the work station 18 above the shell registering plate form a circle so that the shell plate may be manually rotated to bring different shells in contact with different ones of the tools. Typically, the tools sequentially include a sizing die for reshaping the shell's outer wall and dislodging the spent primer from a primer cavity in the shell, a powder dispenser and a bullet positioner and securing element, all mounted above the revolvable shell registering plate so there is no need to rotate the plate for priming at the bottom of the frame rather than at the top support.

In such an embodiment, the carriage is unnecessary and a drive cylinder in the form of a piston may be used to revolvably support the shell registering plate. The piston may be moved in a manner similar to the embodiment of FIG. 1 so that the action of a pivotably mounted lever arm moves the plate toward and away from the tools to simultaneously execute operations by actuating a linkage that is pivotably connected at one end to the frame and at the other end to the operating arm.

Figure 7:
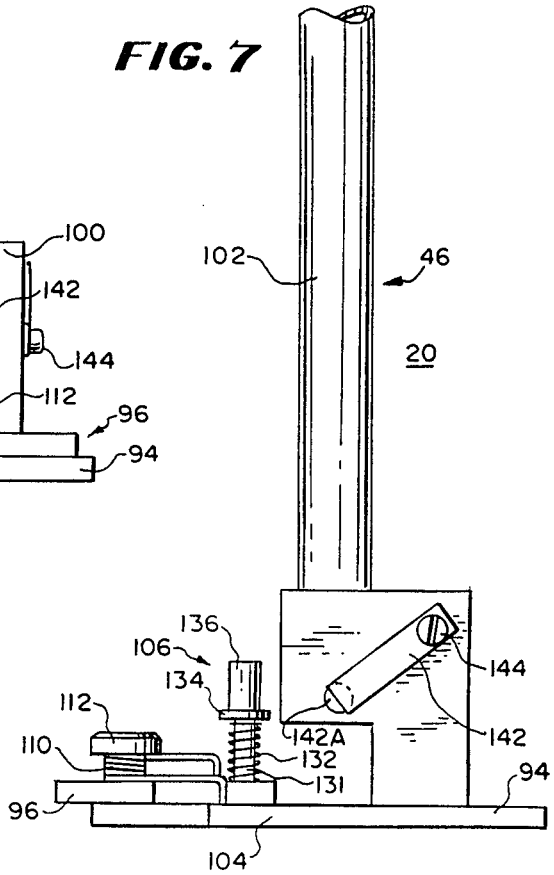
FIG. 7 is a fragmentary side-elevational view of the portion of the loader of FIG. 6.

In FIG. 7, there is shown a side elevational view of the automatic primer 20 showing the spring screw 144 and spring 142 mounted to the body portion 100. As shown in this view, the spring 142 extends at an angle of 45 degrees to the horizontal across the body portion 100 with its edge 142 extending into the opening where it may be contacted by the primer cup 134 when the primer moving portion 104 of the arm 96 moves it within the housing 100 beneath the chute 102. When the cup 134 contacts the spring 142, it moves the edge 142A out of the way of the primers and they drop into the cup 134. Otherwise, the spring 142 impedes the downward passage of primers from the chute 102.

The automatic primer 20 increases the speed of operation and reduces the possibilities of contamination in the loader. Because primers are relatively small and difficult to handle, automatic feed operations avoid a time consuming procedure by automatically inserting the primer in the proper location for feeding. The automatic primer 20 has the advantage of being relatively simple for a progressive loader because the primer holder is located at a station in the path of the reciprocating shell and only a single timing element is attached to the reciprocating portion of the loader to drive the cam follower and this timing element does not move with respect to the reciprocating portion of the loader but only causes a properly timed operation of the automatic primer 20.

To enable the feed mechanism for the primer to have its moving parts located on the frame where they are not mounted for reciprocation with the carriage, the cam attached to the reciprocating portion of the loader must cause a timed motion of a punch for the primer in a direction at an angle to the direction of motion of the shell. If the primer is moved at an angle such as in the preferred embodiment, the horizontal direction of motion (perpendicular to the direction of motion of the shell) must be within the range of 170 thousandths of an inch (0.170) to six inches. If the primer is moved vertically into position and a punch or other device horizontally moved to support it, then the movement of the primer must be at least 0.113 inches and should not be more than three inches.

The cam or other prime mover which is mounted for reciprocation with the carriage, may have a mechanical advantage to the motion for moving the primer which multiplies either force or distance. The ratio of the distance the primer is moved to the distance the cam moves vertically while it is in contact with the mover causing that motion should not be in a ratio greater than ten to one at the point of contact where it moves the automatic primer during reciprocation or there will be insufficient precision of placement of the primer. In the preferred embodiment, the ratio is four to one.

Because the cam surface undergoes some wear, an adjustment must be provided of at least 200 thousandths of an inch (0.200) to compensate from time to time for wear of the cam in the preferred embodiment. The hardness of the cam in the preferred embodiment should be at least Rockwell C of 30 or a Brinell number of at least 289. In the preferred embodiment, the cam angles are 45 degrees to provide a one-to-one motion at the cam surface resulting in a four to one leverage at the location of movement of the primer.

Figure 8:
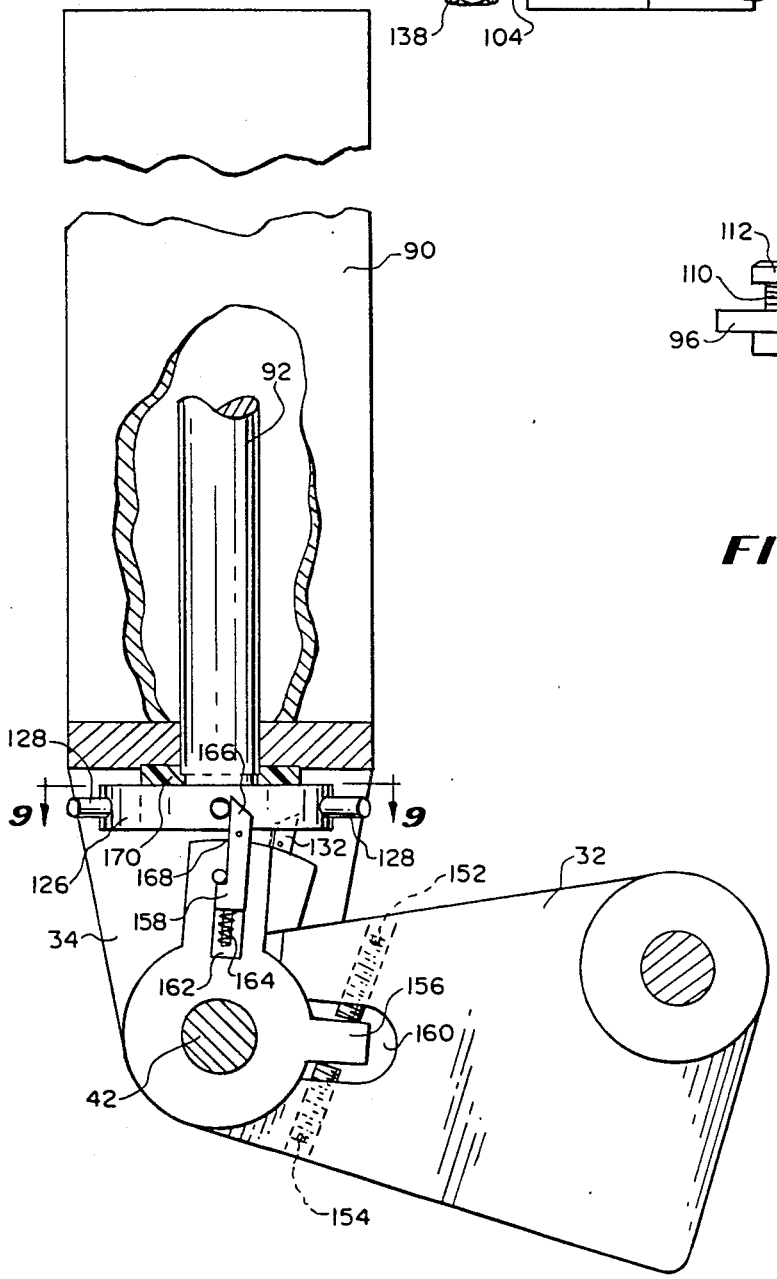
FIG. 8 is an elevational view partly broken away of the embodiment of FIG. 1.

In FIG. 8 there is shown an elevational view of the tubular wall 90 partly broken away to show the indexing shaft 92 connected to the indexing wheel 126 at the yoke 34. As best shown in this view, the pivoting of the rocker arm 32 on the yoke 34 lifts the carriage and at the same time controls the motion of the pawls such as the pawl 130 to time the rotation of the index wheel 126 and index shaft 92.

A pawl housing 150 is mounted for rotation about the pivot point 42 under driving force of the rocker arm 32 in the drive means and held in an adjustable position by the two screws 152 and 154.

The pawl housing 150 is generally cylindrical with a central cylindrical opening through its center for the pivot point 42, an adjusting boss 156 and two extending pawl mounting bosses on each end, one pawl mounting boss being shown at 158.

The pawl mounting bosses of the pawl housing 150 hold within them the pawls 130 and 132 which control the timing of the motion of the index wheel 126 and index drive shaft 92 to cause the shells to move progressively from station to station in synchronism with vertically upward motion to some working stations and vertically downward motion to other working stations.

To permit an adjustment of the angle at which the indexing shaft 92 is turned in relation to the position of the shaft 90 vertically in response to the horizontal motion of the pawls, the adjusting boss 156 rests within a groove 160 at a location controlled by an adjusting means that includes the two screws 152 and 154. Each of the screws 152 and 154 threadably extend through the rocker arm 32 and contact a different side of the adjusting boss 156. Consequently, by loosening one of the screws 152 and tightening the other screw 154, the adjusting boss 156 is located in position within the rock arm 32.

The adjusting boss 156 extends radially from the cylindrical pawl housing 150 so that its position within the rocker arm 32 determines the position of the pawl mounting bosses 158 angularly with respect to the rocker arm 32 and thus the relative position at which the pawls contact the indexing pins of the indexing wheel 126 with respect to the vertical position of the indexing shaft 92.

During the indexing of the indexing shaft 92, a pawl on one side of the pawl housing 150 in one of the two pawl mounting bosses drives the indexing wheel 126 while a corresponding pawl on the opposite end is being driven. The driven pawl (not shown in FIG. 8) is driven substantially vertically downwardly by motion of an indexing pin against an angled surface in the same direction as the indexing shaft 92 and at a direction orthogonal to the plane of the indexing wheel 126.

To permit this downward motion of the pawl, the pawl housings each include a pawl mounting bore such as that shown at 162 in housing 158. A helical compression spring such as 164 is in the bore and holds the pawl 130 upwardly against a restraining pin 165 at a shoulder but permits it to be driven downwardly by an indexing pin. Each of the pawls has a vertical straight surface on one side and a tapered surface 166 on the opposite side which when contacted by one of the pins 128, exerts sufficient force against the helical spring 164 to move the pawl 130 downwardly and out of the path of the indexing pins 128. Thus the straight sides face the same direction in an imaginary circle drawn around the loader and are contacted by pins moving clockwise from the top of the loader.

For this purpose, the slanting surface 166 must have an angle sufficient to form a downward component of the force from the indexing pin greater than the biasing force of the spring 162 which forces the pawl upwardly. In the preferred embodiment, a forty degree angle is utilized but other angles are appropriate provided they exert a sufficient vertical force to move the pawl downwardly.

The pins 128, are driven clockwise by the vertically straight, horizontally cylindrical surface of the pawl such as that shown at 168 so there is no vertical component of force and the forces are principally in the horizontal plane to drive the pin.

To mount the indexing shaft 92 to the indexing wheel 126, the indexing wheel 126 is fixedly fastened to the bottom of the indexing shaft 92 by means of a pin passing through both of them as described hereinafter.

Figure 9:
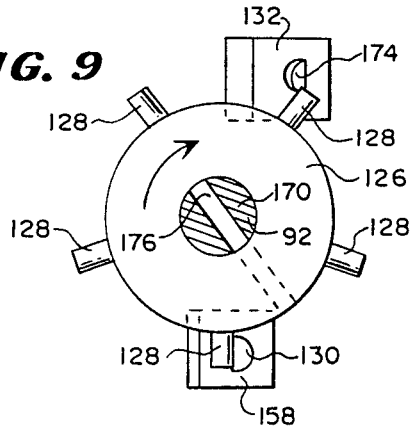
FIG. 9 is a sectional plan view of a portion of the embodiment of FIG. 1.

In FIG. 9 there is shown a fragmentary plan sectional view of the indexing wheel 126, the pawl mounting bosses and the indexing shaft 92. The pawl 130 is shown extending from the mounting boss 158 in driving engagement with an index pin, having its straight vertical edge pushing against the pin while the pawl 132 has its slanted surface 174 being driven by a pin 128 to exert a downward force and drive it into its corresponding boss against spring bias and out of the path of rotation of the indexing wheel 126. The indexing wheel 126 is rotating clockwise.

The rotation of the indexing wheel 126 turns the indexing wheel 92 which is mounted to the indexing wheel 126 by a pin 176 passing through their centers. The angle of the sloping side of the pawls with respect to the horizontal must be forty degrees or less to exert sufficient downward force.

To control the timing of the rotation in the upward and downward movement of the carriage, the length of the pins 128 are equal. The rotation occurs from the time of contact of the pawl with the pin until the pawl's position with respect to the pin moves radially outwardly along the pin and finally passes its end to cease exerting force upon the indexing drive shaft 92.

The length of the pins is between one-fourth inch to two inches and the exact placement of the pin and pawl is set to cause the rotation of the index wheel to locate the shell holder. The shell holder must be properly aligned with both so that the shells are aligned with the proper stations when the carriage is in its lowermost position for priming and in its uppermost position for cooperation in the refinishing and loading station. Because of the rotation on both the upward and downward stroke to a station, stations may be at the top and the bottom and the height of the loader may be reduced to four and one-quarter inches with a sufficient size for loading shells.

The number of pins is equal to 360 degrees of arc divided by twice the smallest arc length between stations. For stations equally spaced, the number of pins is equal to one-half the maximum number of stations in circles on the top and the bottom. The stations are staggered on the top and bottom to cooperate with two pawls which alternately drive different pins to provide rotation in the same direction on both the vertical upward movement and the downward movement.

The pawls are also positioned for precision of the location of the stations during rotation. The length of the pins and the position of the pawls control the amount and time of rotation of the shell holder during raising and lowering of the carriage and are selected to align the shells with the work stations at the time the work stations operate on the shells. Thus the shell holder is rotating during movement vertically near a center of the vertical stroke and then moved straight to the work station. The pawls and pins are in contact during the rotation of the shell holder and out of contact during straight vertical movement.

As the carriage is lifted, the pawl on one side moves upwardly and contacts an index pin 128 after the shell loader has been lifted from the base surface 70. As the carriage continues to move upwardly, the pawl on one side drives the pin and slides along its surface along a line extending radially outwardly from the index wheel 126, with the index wheel 126 turning the shell loader.

As the index wheel 126 rotates and the pin slides radially with the index wheel 126 moving upwardly, the index wheel 126 rotates through thirty-six degrees, and at that point, the pawl is beyond the radial edge of the pin and slides off while the index wheel 126 continues moving upwardly. On the opposite side, a pin has contacted the other pawl at the same time but on its slanted surface so that the pin is depressed downwardly into the pawl housing 150.

As the carriage moves further upwardly, it does not rotate and it is rotationally stationary as it moves up to the finishing and loading station for operation on the shells.

In the downward stroke, the shell holder moves straight down for a period of time until the opposite pawl has its straight edge contacting the pin on the way down. As it moves down, it drives the indexing wheel 126 and shell holder in the same direction through another thirty-six degrees while the pin moves closer to the housing downwardly and the rotation of the indexing wheel 126 causes the pawl to slide radially outwardly with respect to the indexing wheel 126 until its slips beyond its edge. While the driving pawl is contacting a pin with its straight cut-away portion, the pawl on the other side which did the driving on the upward stroke is contacting a pin on its slanted edge and being depressed while it slides radially outwardly beyond the length of the pin.

Thus, the pin lengths control the number of degrees of rotation and may be adjusted in accordance with the angular degrees between a station in the shell finishing and loading section and stations on the surface of the base. The only station on the surface of the base in the preferred embodiment is the priming station and it is located angularly thirty-six degrees from the adjacent stations on the refinishing and loading station above it.

Figure 10:
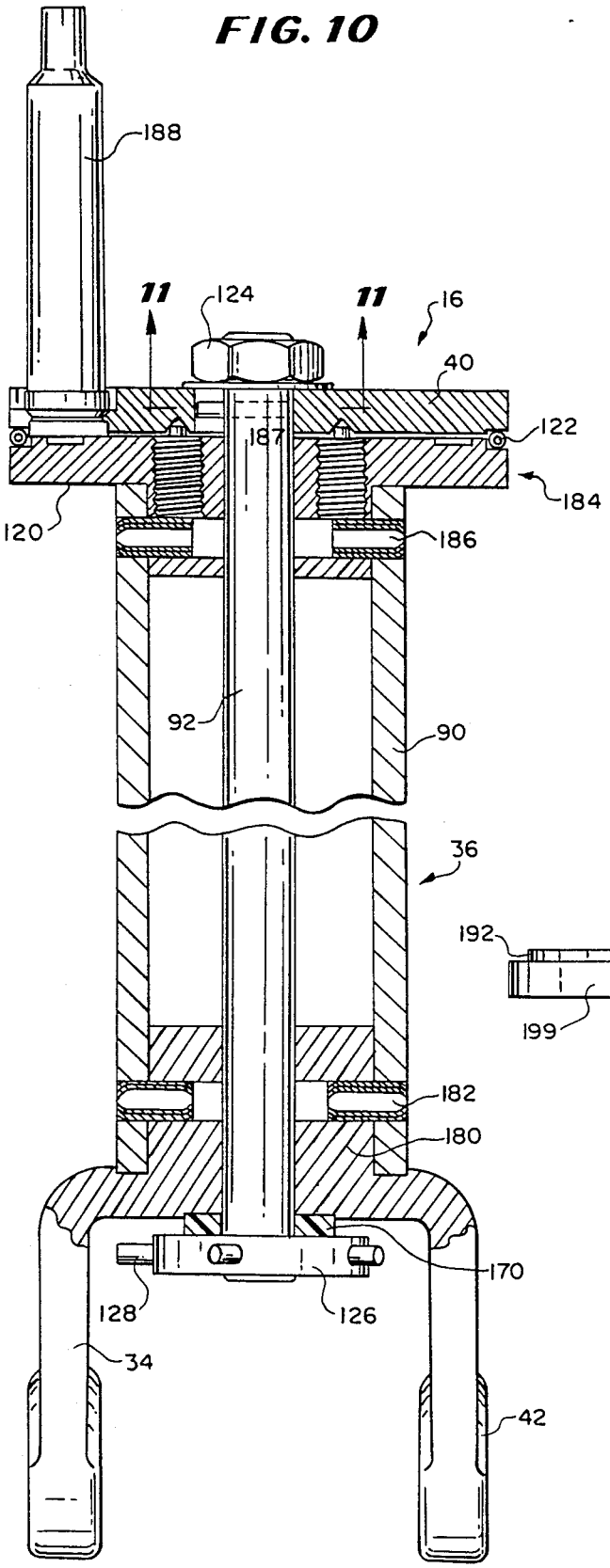
FIG. 10 is a sectional view of a portion of the embodiment of FIG. 1.

In FIG. 10, there is shown a partly broken away elevational view partly sectioned of the turret 16 including the carriage 38. As best shown in this view, the tubular walls 90 are tightly fitted on the yoke 34 about a cylindrical casting at 180 and held in place by pins 182 to be lifted and lowered together with the yoke 34. The indexing shaft 92 passes through the casting 180 so as to rotate therewithin.

At the top of the tubular walls 90, the subplate 184 is fitted within the tubular walls and held in place by pins 186 to be raised and lowered therewith while the indexing shaft 92 rotatably passes therethrough and is held at the top by a nut 124 in engagement with the shell plate 40 through a spring washer. If it is desired to put a different shell plate on, the nut 124 may be easily unthreaded, the shell plate 40 removed and a new one located in its place.

The shell plate 40 is mounted for rotation with the indexing shaft 92 by a pin 187. The subplate 184 has cut-away portions which receive the spring 122 to hold shells such as that indicated at 188 in place. The shells may be different sizes and because of the construction of the shell holder opening and grooves in the subplate the spring holds them tightly in place. Moreover, the shells may be pulled free against the tension of the spring with moderate pressure while still being held firmly enough to be worked upon by the refinishing and loading section.

Figure 11:
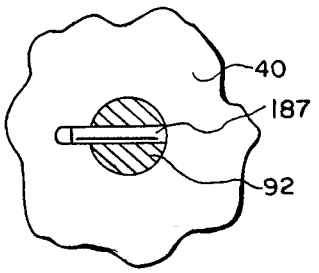
FIG. 11 is a fragmentary sectional view of a portion of the embodiment of FIG. 1.

In FIG. 11 there is shown a sectional view of a portion of the shell plate 40, the indexing shaft 92 at its top and the pin 186 illustrating the manner in which the shell plate 40 is attached to the indexing shaft 92 for rotation therewith. Obviously, other methods of attaching the two may be utilized but the pin is particularly convenient because it may be removed easily when the shell plate is to be changed for a shell plate that will accommodate different size shells or a different number of shells for different configurations.

Figure 12:
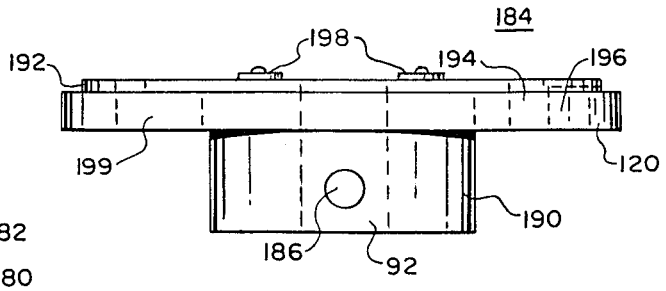
FIG. 12 is an elevational view of another portion of the embodiment of FIG. 1.

In FIG. 12 there is shown a side view of the subplate 184 having a collar 190 through which the indexing shaft 92 passes along an axis and with the transverse aperture 186 therein to receive a roll pin for holding the subplate to the tubular walls 90 for vertical motion therewith. Mounted above the collar 190 is the rim 120 extending outwardly and having in the top surface of its upper periphery a spring receiving groove 192 and a plurality of seating slots extending inwardly to receive shells.

Some of the seating slots include holes extending entirely through the rim such as those shown at 194 and 196 to expose the bottom of the shell and thus permit cooperation of shells with stations on the top surface of 70 (FIG. 1) of the base of the loader when the carriage is in its lowermost portion. Other seats hold shells in place in a manner to be described more completely hereinafter for interaction with refinishing and reloading station at the top of the movement of the carriage. Similarly, at 199 a radially extending ear is supplied for cooperation with the stations at the surface and at a location of approximately 0.563 inches from the center of the subplate 184, two apertures are formed which receive detents 198 on opposite sides of the center. The detents 198 extend upwardly to cooperate with apertures in the shell holder in a manner to be described hereinafter.

Figure 13:
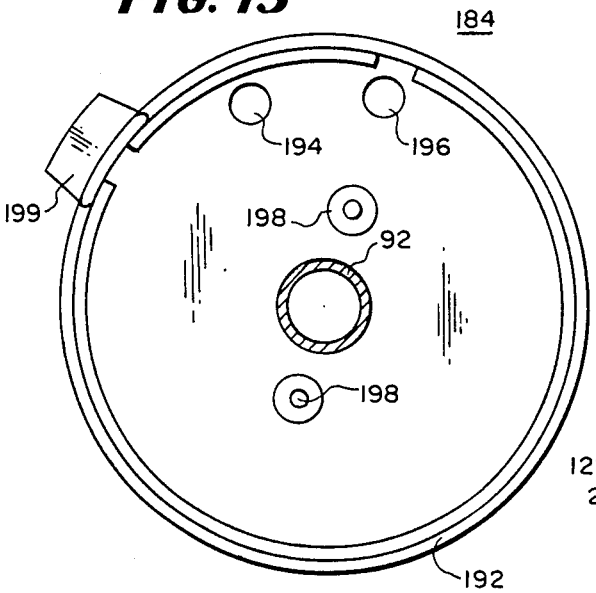
FIG. 13 is a plan view of a portion of the embodiment of FIG. 1.

In FIG. 13 there is shown a plan view of the subplate 184 showing the ear 199 extending radially from the subplate with the indexing shaft 92 extending through a central aperture for rotation within the plate. The position of the apertures 194 and 196 are located to cooperate with the surface 70 (FIG. 1) of the base of the loader when the carriage is at its lower position, at which time the shell holder has been indexed so that shells for priming or the like, at the bottom, are exposed to the work stations.

The groove shown at 192 is designed to cooperate with the shell holder and the spring 122 so as to permit the insertion of different sized shells. When the shells are removed by pulling, the spring 122 is pulled downwardly into the groove so as to permit easy removal and insertion of the shells.

Figure 14:
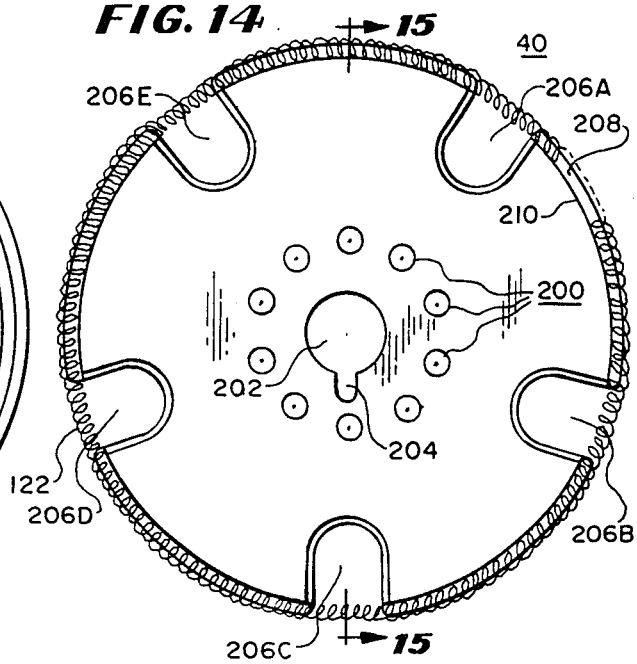
FIG. 14 is a bottom view of a portion of the embodiment of FIG. 1.

In FIG. 14, there is shown a bottom view of the shell plate 40 having ten openings arranged in a circle at 200 having a radius corresponding to the radius of the detents 198 (FIG. 13) on the subplate 184 to provide for seating of the shell plate 40 in any of ten positions, five of which are to be used in the refinishing and loading station at the uppermost stroke of the carriage and others of which are to be used at the lowermost position of the carriage where the shells are brought into contact with a station or stations mounted on the surface 70 (FIG. 1) of the loader 10.

At the center of the shell holder and the center of the ring of openings 200 is a keyway opening 202 sized to fit outside of the indexing shaft 92 (FIG. 13) and receive a key or pin at 204 for the purpose of causing rotation of the shell plate 40 with the indexing shaft 92.

Around the periphery of the shell plate are a plurality of shell holding stations 206A–206E each of which is adapted to hold a shell. The number of shell holding stations is half the number of detents or seating positions so that there is a provision for two stations for each shell to accommodate rotation of the shell plate on both the upper and the lower motions of the carriage. With this provision, a lower vertical height of the loader may be used and a smaller shell plate.

Although the preferred embodiment includes provisions for five shells and ten possible resting locations for working the shells, other numbers of shells may be used and it is not necessary to have half the number of shells as there are detents or angular positions of the plate but it is only necessary that the shells be aligned in register with the stations when they reach the stations and the rotation of the plate must be indexed with sufficient precision for that purpose.

To permit ease of rotation of the shell holder 40 with the subplate 184, a spring holding groove is provided at 192 to receive the retaining spring to hold the shells in place even though they may be of different sizes and a spring holding groove 208 is provided around the periphery at the bottom of the shell holder 40.

Figure 15:
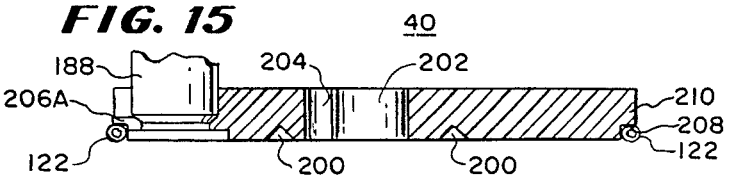
FIG. 15 is a sectional view of a portion of the embodiment of FIG. 1 shown in FIG. 14.

In FIG. 15, there is shown a sectional view taken through lines 15—15 of FIG. 14 showing the shell holder 40. As best shown in this view, the spring 122 grips the edge of a shell 188 seated within one of the shell seats 206A to hold it in place beyond the walls 90 (FIG. 8) of the carriage. With this arrangement, the shell is held inwardly even though it may be of smaller size than the shell holding opening 206A yet may be easily pulled free by rolling the spring 122 downwardly over the subplate 184 (FIG. 13).

Figure 16:
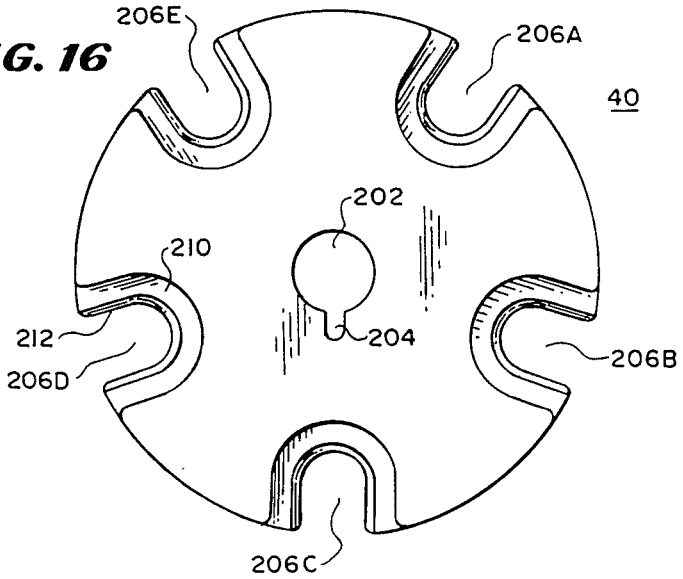
FIG. 16 is plan view of a portion of FIG. 1 shown in FIG. 14.
Figure 17:
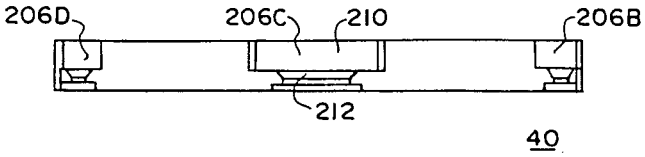
FIG. 17 is a front elevational view of the portion of FIG. 1 shown in FIG. 14.

In FIGS. 16 and 17 there is shown a plan view and front elevational view of the shell holder 40 illustrating the two size shell holding apertures 206A–206B having a first large section 210 and a smaller lower section 212 both of which are covered around the periphery by the helical spring 122 which is formed as an annulous to hold different size shells within the walls of either the larger compartment 210 or the smaller opening 212.

From the above description it can be understood that several advantages are provided by the loader 10 such as: (1) it has a relatively short elevation; (2) it provides for work stations both at the top and the bottom of the carriage movement; (3) it is relatively simple and inexpensive; (4) it is relatively safe; (5) it rotates a shell holder during both upward and downward motion; (6) it holds different size shells; and (7) it permits easy removal and insertion of shells.

Although a preferred embodiment of the invention has been described with some particularity, many modifications and variations are possible within the light of the above teachings. Therefore, it is to be understood that, within the scope of the appended claims, the invention may be practiced other than as specifically described.

What is claimed is:

1. Reloading apparatus comprising:

carriage means adapted to support a shell holder having a number of positions each of which may hold a separate casing;

a punch for removing a spent primer at a first location;

a priming station at a second location;

means for moving the carriage means vertically between the first location and the second location whereby the spent primer may be removed at the first location and a new one inserted at the second location;

means for holding a supply of primers having a hollow vertical elongated column adapted to receive said primers one above the other for gravity feeding thereof;

lever means having a cam follower on one end, a primer holder on the other end and a pivot point located between its two ends for moving said primers one at a time to the second location mounted in juxtaposition with said second location;

said carriage means including means for carrying a cam into engagement with said cam follower, whereby a primer is inserted in said location by the motion of said carriage means;

means for moving said shell holder from position to position successively in a horizontal plane whereby each shell is deprimed and primed during the movement of said carriage between said first position and said second position;

said shell holder having a rim extending beyond the carriage means a sufficient distance to receive the primer thereunder;

the distance from the edge of the rim to the location of said means for holding being at least one-half the diameter of a shell;

said primer holder including a primer punch and seat assembly;

spring means for biasing the primer punch and seat assembly to one and one-half inches from the center of the shell holder;

the length of the primer moving section being sufficient to swing under action of the cam follower through an arc that brings it underneath the means for holding;

the priming station includes a horizontal support plane;

the primer punch and seat assembly being supported by a compression spring at a height of approximately one fourth of an inch from the support plane;

the means for holding including an opening positioned to receive the primer punch and seat assembly extending from the support plane to an elevation from the bottom of the support plane slightly less than a quarter of an inch to permit removal of the primer;

the cam follower is shaped so that when it is moved by the cam surface, the primer punch and seat assembly is swung on the primer moving section through the distance between the second location and the means for holding to receive a primer through an arc of approximately 30 degrees;

the distance from the center of the primer punch and seat assembly and the center of the pivot point being two and one-fourth inches;

the distance to the cam follower at the start of motion upwardly being approximately one-half of an inch; and said lever means being mounted for motion under the driving force of said cam follower in a direction at an angle to the direction of motion of the carriage within the range of 170 thousandths of an inch to six inches.

2. Reloading apparatus according to claim 1 in which said means for moving has a mechanical advantage with a ratio of the distance the cam follower is driven upwardly by the cam to the distance the primer holder moves of less than 10 to 1.

3. Reloading apparatus comprising:

carriage means adapted to support a shell holder;

a punch for removing a spent primer at a first location;

a priming station at a second location;

means for moving the carriage means between the first location and the second location whereby the spent primer may be removed at the first location and a new one inserted at the second location;

means for holding a supply of primers;

means for moving said primers one at a time to the second location;

said means for moving said primers being mounted in juxtaposition with said second location;

said means for moving said primers including a cam follower;

said carriage means including means for carrying a cam into engagement with said cam follower, whereby a primer is inserted in said location by the motion of said carriage means; and means for moving said shell holder from position to position in a plane at an angle to the direction of movement of said carriage means in moving between said first and second locations;

said shell holder having a number of positions each of which may hold a separate casing; and said means for moving said shell holder from position to position including means for sucessively moving said shell holder whereby each shell is deprimed and primed during the movement of said carriage between said first position and said second position.

4. Reloading apparatus according to claim 3 in which said means for holding a supply of primers includes a hollow vertical elongated column adapted to receive said primers one above the other for gravity feeding thereof.

5. Reloading apparatus according to claim 3 in which:

said means for moving said shell holder includes lever means having a cam follower on one end and a primer holder on the other;

said lever means having a pivot point located between its two ends;

a cam follower being positioned in the path of movement of said cam; and said lever means being pivoted between its two ends.

6. Reloading apparatus according to claim 5 in which said means for carrying said cam into engagement includes a cam arm that is sufficiently long to extend between the means for carrying to which it is fastened and the second location when the carriage means is fully extended to the first location, whereby said lever arm is brought to said second location under the rim of the shell holder to be aligned with the center of the shell.

7. Reloading apparatus according to claim 5 in which:

the shell holder has a rim;

said rim of the shell holder extends beyond the carriage means a sufficient distance to receive the primer thereunder;

said lever means is moved by the cam surface a sufficient distance to move a primer from said means for holding into a path under the shell within the rim; and the distance from the edge of the rim to the location of said means for holding being at least one-half the diameter of a shell.

8. Reloading apparatus according to claim 7 in which:

said primer holder includes a primer punch and seat assembly; and said lever means includes a spring means for biasing the primer punch and seat assembly in a position where it underlines the shell on the shell holder when that holder is moved downwardly.

9. Reloading apparatus according to claim 8 in which said spring means biases the primer punch and seat assembly to one and one-half inches from the center of the shell holder.

10. Reloading apparatus according to claim 8 in which:

the primer punch and seat assembly is sized to receive a primer snugly;

the length of the primer moving section is sufficient to swing under action of the cam follower through an arc that brings it underneath the means for holding; and said means for holding including a spring catch positioned to permit a primer to be seated in the primer punch and seat assembly for removal from the means for holding.

11. Reloading apparatus according to claim 4 in which:

the priming station includes a horizontal support plane;

the primer punch and seat assembly is supported by a compression spring at a height of approximately one fourth of an inch from the support plane; and the means for holding includes an opening positioned to receive the primer punch and seat assembly extending from the support plane to an elevation from the bottom of the support plane slightly less than a quarter of an inch to permit removal of the primer.

12. Reloading apparatus according to claim 10 in which:

the cam follower is shaped so that when it is moved by the cam surface, the primer punch and seat assembly is swung on the primer moving section through the distance between the second location and the means for holding to receive a primer through an arc of approximately 30 degrees;

the distance from the center of the primer punch and seat assembly and the center of the pivot point being one and one-fourth inches; and the distance to the cam follower at the start being approximately one-half of an inch.

13. Reloading apparatus according to claim 11 in which:

the body portion includes a slot in its walls; and the spring catch includes a spring extending horizontally through the slot where its bottom end may be contacted by the primer cup when the primer moving portion of the feed arm moves it within the housing beneath the chute, whereby the cup contacts the spring and moves the upper portion out of the way of the primers to permit them to drop into the cup.

14. Reloading apparatus according to claim 3 in which said lever means is mounted for motion under the driving force of said cam follower in a direction at an angle to the direction of motion of the carriage within the range of 170 thousandths of an inch to six inches.

15. Reloading apparatus according to claim 14 including means for moving said primer holder vertically into position and said punch horizontally into position; and said means for moving said primer holder including means for moving said primer holder between 0.113 inches and three inches.

16. Reloading apparatus according to claim 14 in which said means for moving has a mechanical advantage with a ratio of the distance the cam follower is driven upwardly by the cam to the distance the primer holder moves of less than 10 to 1.

17. Reloading apparatus according to claim 11 in which said means for moving has a mechanical advantage with a ratio of the distance the cam follower is driven upwardly by the cam to the distance the primer holder moves of four to one.

18. Reloading apparatus according to claim 3 including means for adjusting the position of said cam at least 200 thousandths of an inch to compensate from time to time for wear of the cam.

19. Reloading apparatus according to claim 3 in which the hardness of the cam is at least Rockwell C of 30 and a Brinell number of at least 289.

* * * * *